US010458650B2

(12) United States Patent
Pardo et al.

(10) Patent No.: US 10,458,650 B2
(45) Date of Patent: Oct. 29, 2019

(54) METHODS AND SYSTEMS FOR FLUE GAS DENITRIFICATION

(71) Applicant: Degremont, Paris la Defense (FR)

(72) Inventors: Pierre-Emmanuel Pardo, Orsay (FR); Ludovic Morice, Chaumont en Vexin (FR)

(73) Assignee: DEGREMONT, Paris la Defense (FR)

( * ) Notice: Subject to any disclaimer, the term of this patent is extended or adjusted under 35 U.S.C. 154(b) by 543 days.

(21) Appl. No.: 13/865,393

(22) Filed: Apr. 18, 2013

(65) Prior Publication Data

US 2013/0333597 A1 Dec. 19, 2013

(30) Foreign Application Priority Data

Apr. 19, 2012 (FR) ..... 12 53597

(51) Int. Cl.

| | |
|---|---|
| ***F23J 7/00*** | (2006.01) |
| ***F23G 5/30*** | (2006.01) |
| ***F23G 7/00*** | (2006.01) |
| ***F23J 3/00*** | (2006.01) |

(52) U.S. Cl.

CPC ..... *F23J 7/00* (2013.01); *F23G 5/30* (2013.01); *F23G 7/00* (2013.01); *F23J 3/00* (2013.01); *F23G 2201/701* (2013.01); *F23J 2215/10* (2013.01)

(58) Field of Classification Search

CPC .... F23J 3/00; F23J 7/00; F23J 2215/10; F23J 2215/101; F23G 5/30; F23G 7/00; F23G 7/001; F23G 2201/701

See application file for complete search history.

(56) References Cited

U.S. PATENT DOCUMENTS 4,648,331 A * 3/1987 Thelen ..... F23J 7/00 110/342
4,708,067 A * 11/1987 Narisoko ..... F23J 7/00 110/245

(Continued)

FOREIGN PATENT DOCUMENTS

| | | | |
|---|---|---|---|
| GB | 2348270 | 9/2000 | |
| WO | WO 9504245 A1 * | 2/1995 | ..... F23G 5/30 |
| WO | WO 9604508 A1 * | 2/1996 | ..... F23G 5/30 |

OTHER PUBLICATIONS

Olsson, Johanna. Modeling of Bubble FLow in Fluidized Bed Combuation Units. 2008.*

(Continued)

*Primary Examiner* — Jianying C Atkisson
*Assistant Examiner* — Tavia Sullens
(74) *Attorney, Agent, or Firm* — Young & Thompson

(57) ABSTRACT

A process for nitrification, in the heterogeneous phase, of the flue gases produced by a combustion furnace (1), in particular a furnace for incinerating waste or sludge from a municipal water or industrial water purification plant, according to which the fuel is introduced into a fluidized bed (B) or onto a grate, and combustion air (2) is injected into the furnace; a reducing agent (6) is injected into the fuel and/or into the combustion air, upstream of the combustion chamber (H), and is mixed homogenously with the fuel and/or the combustion air, in order to carry out a reducing treatment promoted by the bed (3) of ash or of solids present in the furnace.

7 Claims, 3 Drawing Sheets

(56) References Cited

U.S. PATENT DOCUMENTS

| | | | | |
|---|---|---|---|---|
| 5,536,482 | A * | 7/1996 | Diep | B01D 53/56 423/235 |
| 5,915,310 | A * | 6/1999 | Hura | F23C 6/047 110/345 |
| 6,375,909 | B1 | 4/2002 | Dangtran | |
| 7,374,736 | B2 * | 5/2008 | Payne | B01D 53/56 423/235 |
| 2007/0231231 | A1 | 10/2007 | Zabetta | |
| 2011/0271886 | A1 | 11/2011 | Fujiwara | |

OTHER PUBLICATIONS

French Preliminary Search Report for French Patent Application FR 1253597.

* cited by examiner

METHODS AND SYSTEMS FOR FLUE GAS DENITRIFICATION

The present invention claims priority from French patent application FR 12 53597, filed Apr. 19, 2012, incorporated by reference in its entirety.

The invention relates to a process for the denitrification of the flue gases produced by a combustion furnace, in which a fuel is introduced into a fluidized bed or onto a grate, and combustion air is injected into the furnace.

The invention relates more particularly, but not exclusively, to such a process for the denitrification of the flue gases produced by a furnace for incinerating waste or sludge of municipal water or industrial water purification plants.

BACKGROUND OF THE INVENTION

During a combustion, unlike sulfur oxides, acids and heavy metals, the emissions of which are intrinsically linked to the content of sulfur, of Cl (chlorine), Br (bromine), F (fluorine), I (iodine), and of heavy metals of the fuel used, the amount of nitrogen oxides generated is a function, to a certain extent, of the fuel used, but also of the conditions under which the combustion takes place. Therefore there is no univocal relationship between the emissions of nitrogen oxides and the fuel. At the very most, when one has a good knowledge of a given process (coal, heavy fuel oil, natural gas, etc. thermal power plant), it is possible to formulate an emission factor which will be used inter alia as a base reference for the advances and reductions in the emissions of nitrogen oxides which could be obtained by subsequent research and development.

The combustion of a hydrocarbon-based compound is therefore always accompanied, in addition to carbon dioxide $CO_2$, water $H_2O$, and nitrogen $N_2$, by a production of nitrogen oxides. These oxides are represented by nitrogen monoxide (NO), nitrogen protoxide ($N_2O$), and by a very small proportion of nitrogen dioxide ($NO_2$).

From an environmental and health viewpoint, it is important to reduce their emissions therein since each of these nitrogen oxides has a significant impact:

- NO participates in the phenomenon of acid rain and in the formation of tropospheric ozone;
- $N_2O$ is a greenhouse gas three hundred and ten times more powerful than $CO_2$.

In order to reduce the emissions of NOx, processes have been developed, in particular the following two processes:

- a non-catalytic process operating at high temperature, above 800° C. in the combustion chamber, this process being denoted by the acronym SNCR (selective non-catalytic reduction);
- a catalytic process that operates with regard to the treatment of the flue gases, at medium temperature (300° C.-400° C.) or at low temperature (180° C.-230° C.), this process being denoted by the acronym SCR (selective catalytic reduction).

The SCR process makes it possible to abate large amounts of NOx, but at the expense of major economic and environmental drawbacks. The more economical SNCR process does not make it possible to achieve a nitrogen oxides removal efficiency as high as the SCR process.

The objective of the invention is, above all, to provide a process for the denitrification of flue gases, of the SNCR process type, the nitrogen oxides removal efficiency of which is higher so as to tend toward the performances of an SCR process, and to have an effective, relatively economic, denitrification process with as low as possible an environmental impact.

Current Problem with the SNCR Process

The SNCR process for reducing nitrogen oxides consists in directly injecting the reducing agent into the combustion chamber in a zone where the temperature of the gaseous effluents is preferably between 850° C. and 1000° C.

By using ammonia as a reducing agent, the chemical reactions given below occur more or less simultaneously. At a temperature below 850° C., the reactions are too slow; at a temperature above 1000° C., the secondary reaction dominates with an increase in nitrogen oxides.

Main reaction:

$$4NO+4NH_3+O_2 \rightarrow 4N_2+6H_2O \text{ (reduction)}$$

Undesired secondary reaction:

$$4NH_3+5O_2 \rightarrow 4NO+6H_2O \text{ (oxidation)}$$

The temperature window takes on considerable importance since, if the temperature is too high, the ammonia is oxidized which leads to a production of nitrogen oxides; if it is too low, the degree of conversion will be too low and the ammonia will be observed downstream (ammonia leak).

The reaction of the nitrogen oxides and of the ammonia, or of the urea, in water and nitrogen depends strongly on the temperature and on the residence time in the required temperature range. The temperature window for an aqueous ammoniacal solution (aqueous ammonia) lies between 800° C. and 1100° C., the optimum temperature being 930° C./960° C.

By way of comparison, the temperature window when urea is used is narrower (between 850 and 1050° C.), the optimum temperature being 960° C./980° C.

A first difficulty with the SNCR process is therefore the narrowness of the optimum temperature window.

A second difficulty consists in thoroughly mixing the gases to be treated with the reducing agent, also referred to as reactant.

SUMMARY OF THE INVENTION

In order to achieve a high degree of reduction and a low release of $NH_3$, the reducing agent and the nitrogen oxides NOx of the flue gases must be sufficiently mixed otherwise the reaction does not take place and a portion of the nitrogen oxides NOx is not treated, or else the ammonia $NH_3$ does not react. Most of the problems faced by selective non-catalytic reduction applications relate to the non-uniform distribution of the reducing agent in the combustion chamber.

Besides the distribution and the mixing, another important parameter is the size of the droplets of a liquid reducing agent. Small droplets would evaporate too rapidly and would react at temperatures that are too high, which would lead to a drop in the degree of reduction of the nitrogen oxides, whereas larger droplets would evaporate too slowly and would react at temperatures that are too low, which would lead to a larger release of ammonia $NH_3$.

The choice of the reducing agent also influences the formation of by-products such as nitrogen protoxide ($N_2O$). The use of ammonia and of caustic ammonia produces negligible amounts of $N_2O$ whereas relatively large amounts can be measured during the direct injection of urea into the combustion chamber.

The residence time in the required temperature range varies from 0.2 to 0.5 s. This contact time range is rather unstable; this is the reason why the ammonia/nitrogen oxides ratio must be rich in ammonia instead of being stoichiometric. Here too, it is necessary to optimize the $NH_3$/NOx molar ratio. The degree of removal of the NOx is favored by a higher ratio, but the release of ammonia also increases, which leads to an increased pollution of the equipment placed downstream (heat exchangers, flue gas treatment). In order to neutralize these two contrary effects, the $NH_3$/NOx ratio is limited to a range between 1.5 and 2.5.

In the case of a fluidized bed furnace for combustion of purification plant sludge, the temperature in the combustion chamber lies between 850° C. and 870° C. This temperature level is not favorable to the use of the SNCR process under the best conditions, which limits the degree of abatement of the nitrogen oxides to 40-50% and generates reaction by-products such as ammonia $NH_3$ or nitrogen protoxide $N_2O$. This distinctive feature adds to the imperfections of mixing operations linked to the injection of a reducing agent into a large-volume chamber.

Furthermore, during the evaporation of the aqueous ammonia solution, the temperature of the combustion chamber will drop as a function of the necessary amount of reducing agent. This drop is detrimental for obtaining the European regulatory temperature of 850° C. for 2 s (T2 s).

The invention aims, above all, to provide an improved process for the denitrification of the flue gases produced by a combustion furnace, which process, while being of the SNCR process type, makes it possible to address, at least partly, the major drawbacks of the treatment of nitrogen oxides NOx by the SNCR process:

- low yield of the reaction (NSR>2 for outgoing NO/incoming NO=60%);
- homogeneity of the reducing agent/gas mixture difficult to obtain;
- production of by-products ($NH_3$/$N_2O$);
- absence of impact on the regulatory temperature T2 s.

According to the invention, the process for denitrification, in the heterogeneous phase, of the flue gases produced by a combustion furnace, in particular a furnace for incinerating waste or sludge from a municipal water or industrial water purification plant, according to which process a fuel is introduced into a fluidized bed or onto a grate, and combustion air is injected into the furnace, is characterized in that a reducing agent is injected into the fuel and/or into the combustion air, upstream of the combustion chamber, and is mixed homogenously with the fuel and/or the combustion air, the reducing agent being chosen to ensure the reduction of the nitrogen oxides to nitrogen, so that the reducing agent carries out a reducing treatment promoted by the layer of solids or ash present in the furnace.

The temperature of the gases in the combustion chamber of the furnace is, in general, below 900° C.

Preferably, the reducing agent is chosen from ammonia-based chemical compounds.

The application of the denitrification reaction in the heterogeneous phase by using the combustion zone (sand bed or waste grate) as a preferential denitrification reaction zone and by profiting from the heterogeneous catalytic aspect of this zone, makes it possible to address, at least partly, the drawbacks listed above.

This arrangement is a very simple implementation and guarantees the lowest possible consumption of reducing agent. If there is a place where the homogeneity is guaranteed, it is indeed the combustion zone of the solid waste and in particular the sand bed in a fluidized bed furnace.

The invention thus consists in injecting the reducing agent, in particular a solution of denitrifying reactant, directly into the fuel and/or into the combustion air before it is introduced into the furnace, as homogeneously as possible. Thus, the reducing agent is vaporized at the same time as the water and the volatile material contained in the fuel, and its distribution, is provided in the same way as the fuel charge, by the fluidization of the sand bed.

This intense mixing, in addition to obtaining the homogeneity, ensures the coexistence of the NOx/reducing agent/catalytic bed (sand+ash) and enables denitrification reactions to take place that are catalyzed at relatively low temperatures, of the order of 800° C., which are not possible in the homogeneous gas/gas phase at higher temperature according to the conventional SNCR process.

The heterogeneous (catalytic) reactions are of the type:

$$4NH_3+4NO+O_2+C \rightarrow N_2+H_2O \text{ (catalysis of the waste by carbon)},$$

$$4NH_3+4NO+O_2+CaO \rightarrow N_2+H_2O \text{ (catalysis of the waste by ash)}.$$

If the reactions are not complete, the higher temperature and the time greater than 2 s (2 seconds) in the post-combustion enable denitrification reactions at 850° C.-870° C. in the homogeneous phase, without the drawbacks of a conventional SNCR process.

The reducing agent may be injected into the solid fuel and mixed therewith before being introduced into the combustion chamber. The reducing agent is injected with a solid, liquid or gaseous co-reactant (lime, limestone, etc.).

It is possible to inject reducing agent into a liquid or gaseous fuel feeding a zone where solid fuels are present in the furnace.

It is possible to inject reducing agent into a solid waste, sand or ash, which is recirculating.

The reducing agent may be injected into the combustion air of the furnace upstream of the combustion chamber.

The reducing agent and the fuel are preferably mixed in a mixing member.

In the case of a fluidized sand bed furnace comprising a device for the homogeneous distribution of air through the sand bed, the reducing agent may be injected into the box for distributing the combustion air, also referred to as a wind box.

The reducing agent may be chosen from ammonia or urea.

Preferably, the reducing agent is vaporized prior to its injection into the combustion air.

The reducing agent may be injected directly in the solid, liquid or gaseous phase with optional dilution with water.

When the reducing agent is injected directly in the liquid phase in sprayed form, the spraying of the reducing agent may be assisted by addition of air using spray nozzles.

Advantageously, in the case of a fluidized sand bed furnace, the temperature of the sand bed where the heterogeneous reduction takes place is controlled by adjusting:

- the preheating of the fluidization air, and/or
- the stoichiometry of the combustion air, and/or
- the height of the sand layer, and/or
- the use of auxiliary fuel.

Generally, the content of nitrogen oxides NOx and/or of ammonia $NH_3$ is monitored directly at the outlet of the combustion chamber, and the injection of the reducing agent is regulated as a function of the measured contents of NOx and/or of ammonia $NH_3$.

The reducing agent may be injected, at least partly, into a flue gas recycle stream.

Advantageously, the temperature of the devolatilization zone where the heterogeneous reduction takes place is controlled by adjusting the preheating of the fluidization air, and/or the stoichiometry of the combustion air, and/or the height of the sand layer, and/or the use of auxiliary fuel.

The invention also relates to a plant for the implementation of a process as defined previously, this plant comprising a combustion furnace, in particular a furnace for incinerating waste or sludge from a municipal water or industrial water purification plant, the fuel being introduced into a fluidized bed or onto a grate, and combustion air being injected into the furnace, and being characterized in that it comprises a line for injecting a reducing agent into the fuel line and/or into the combustion air line, upstream of the combustion chamber, and a mixing member in order to carry out a homogeneous mixing of the reducing agent with the fuel and/or the combustion air.

Advantageously, the plant comprises a control member for the flow of reducing agent, and at least one sensor of the NOx content or ammonia $NH_3$ content of the flue gases, at the outlet of the furnace, which sensor controls the control member.

BRIEF DESCRIPTION OF THE DRAWINGS

The invention consists, apart from the arrangements set out above, of a certain number of other arrangements, which will be mentioned more explicitly below regarding exemplary embodiments described with reference to the appended drawings, but which are not limiting. In these drawings.

DESCRIPTION OF THE INVENTION

Figure 1:
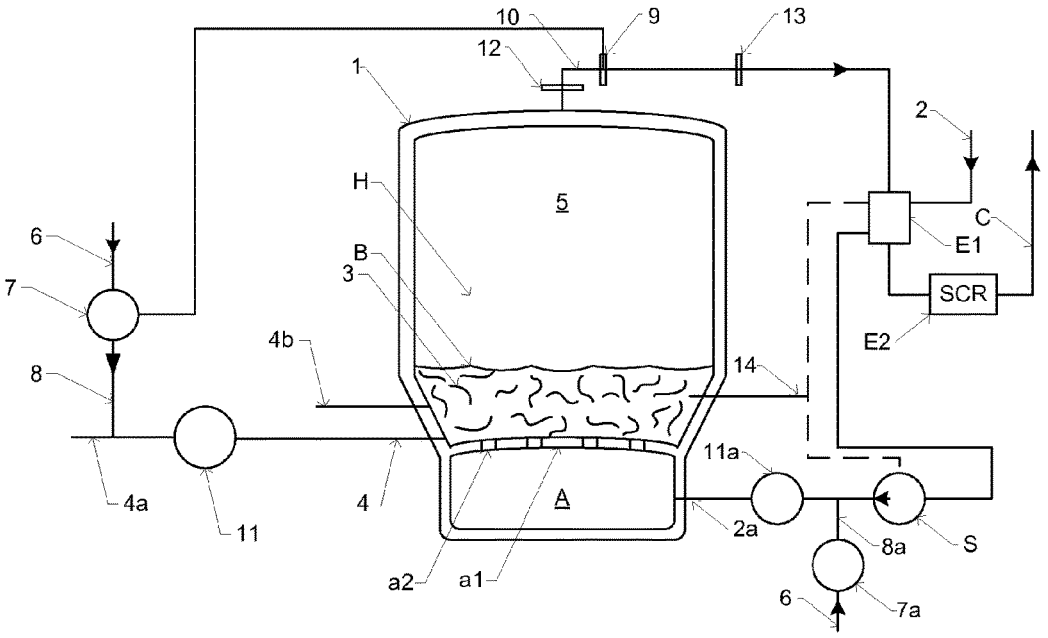
FIG. 1 is a diagram of a fluidized bed incineration furnace for purification plant waste or sludge, implementing the process of the invention.

With reference to FIG. 1 of the drawings, it is possible to see a combustion furnace 1 having a fluidized sand bed B, according to which the combustion air and fluidization air 2 is introduced partly below in a wind box A surmounted by an arch a1 supporting the bed B. Nozzles a2 that ensure the distribution of the air blown into the bed B pass through the arch a1. A furnace of this type is known under the name Thermylis® from the company Degrémont. In general, the temperature of the gases in the combustion chamber of the furnace is below 900° C.

The bed B constitutes a devolatilization zone 3 which contains the waste in the solid phase and in which the volatile components devolatilize and partly burn. It is recalled that the devolatilization of a fuel denotes the process via which, during a heat treatment, the fuel loses its volatile components (water, hydrocarbon-based matter, carbon monoxide, hydrogen, etc.).

The fuel is introduced at the bottom part of the bed B via at least one side nozzle 4. A post-combustion zone 5 is located in the chamber of the furnace above the bed B.

The injection 4 of the fuel thus takes place in the devolatilization zone 3. The fuel may consist of the purification plant sludge, household waste, fuel oil, or gas, or any organic waste that is introduced into a furnace in order to burn it.

According to a first aspect of the invention, a reducing agent 6 is injected directly into the fuel, in particular sludge or waste, before introduction into the combustion chamber H level with the devolatilization zone 3. This injection may take place by means of a control member 7 for controlling the flow rate of the reducing agent. The injection of the reducing agent 6 is carried out by a pipe 8 connected to the fuel inlet line 4*a*. The control member 7 may be of the valve, variable flow pump or rotary screw feeder type or any other device that makes it possible to regulate the flow rate of the reducing agent.

This reducing agent 6 may consist of a solution of aqueous ammonia, of gaseous ammonia, of urea in solution, of cyanhydric acid, or any other reactant which ensures the chemical reduction of the nitrogen oxides NOx. The reducing agent 6 may also be in the form of a pulverulent material, especially in the case where it consists of urea.

The flow rate control member 7 may be controlled by a measurement of the concentration of nitrogen oxides NOx or of ammonia $NH_3$ downstream of the furnace 1, especially using a sensor 9 located on an outlet line 10 of the flue gases from the furnace 5. Preferably, the sensor 9 is installed at the outlet of the post-combustion zone 5.

A mixing device or member 11 is installed on the fuel inlet line 4*a*, downstream of the injection of the reducing agent, in order to produce a homogeneous mixture and intimate contact between the fuel and the reducing agent 6. This mixing device may consist of a screw, a kneader, a turbulence zone or simply a long tube or any means that make it possible to have at the inlet of the devolatilization zone 3 the finest possible mixture of the fuel and of the reducing agent 6.

It should be noted that, according to the invention, it is also possible to inject the reducing agent 6 into an auxiliary fuel, fuel oil or gas, which may be introduced into the furnace by a nozzle 4*b* other than the nozzle 4, in order to stabilize the combustion. It is also possible to inject the reducing agent 6 into any solid product such as ash or sand recirculated in the devolatilization zone 3.

Preferably, a probe 12 for measuring the concentration of nitrogen oxides NOx is provided on the line 10 just downstream of the post-combustion zone 5. A probe 13 for measuring the concentration of ammonia $NH_3$ in the flue gases is also provided downstream of the combustion on the line 10 in order to monitor the over-stoichiometry of the reaction. One of the two probes 12, 13 may be merged with the sensor 9.

Temperature sensors of the combustion zone are provided in the furnace, in particular a sensor 14 of the temperature of the heterogeneous zone constituted by the bed B with the presence of solids, sand or waste or of gas, These temperature sensors are implanted in order to monitor and adapt the temperature in the zone in question, in particular by varying the preheating, via a preheater E1, of the combustion air that arrives via the line 2, and by adjusting the stoichiometry or over-stoichiometry of the combustion via action on a blower S giving the flow of fuel and/or of combustion air.

According to a second aspect of the invention, which may be combined with the first, the reducing agent 6 may be injected into the combustion air and fluidization air via a line 8*a* connected to the air inlet line 2*a* linked to the outlet of a blower S. A mixing device 11*a* is provided on the line 2*a* downstream of the injection of the reducing agent in order to ensure a homogeneous and intimate mixture before arrival in the wind box A, also referred to as distribution box of the combustion air.

The flue gases exiting via the line 10 pass through the preheater E1, consisting in particular of a unit that forms a heat exchanger with the combustion air 2. Before release at the chimney stack C, the flue gases may pass through a unit E2 providing a treatment for eliminating the remaining nitrogen oxides by a selective catalytic reaction (SCR).

The invention is preferably used in a fluidized sand bed furnace according to the example in FIG. 1, in order to exploit the highly catalytic nature of this bed.

However, the invention may also be used in a grate furnace 1*b* (FIG. 2) comprising a grate 15 inclined from the inlet 15*e* of the materials to be burned, in particular municipal waste, to the outlet 15*s* of the residues and ash. A bed 3*b* of combustion materials and of ash is formed on the grate 15. The combustion air is introduced via a line 2*b* on which a blower Sb is installed. The combustion air 16 is blown into a distribution chamber Ab below the grate 15 while being spread over the entire area of this grate by a spray boom or a device that is not represented.

The reducing agent is injected, into the combustion air, in gaseous form, or liquid form, in particular as a dispersion of droplets, or in solid form, in particular as a powder. The injection takes place in the line 2*b*. A mixing device 11*b*, located downstream of the injection, ensures a homogeneous mixture and an intimate contact between the air and the reducing agent. This mixture is blown under the grate 15 and passes through the grate 15 and the bed 3*b*, which plays a role similar to that of the bed B from FIG. 1.

Figure 2:
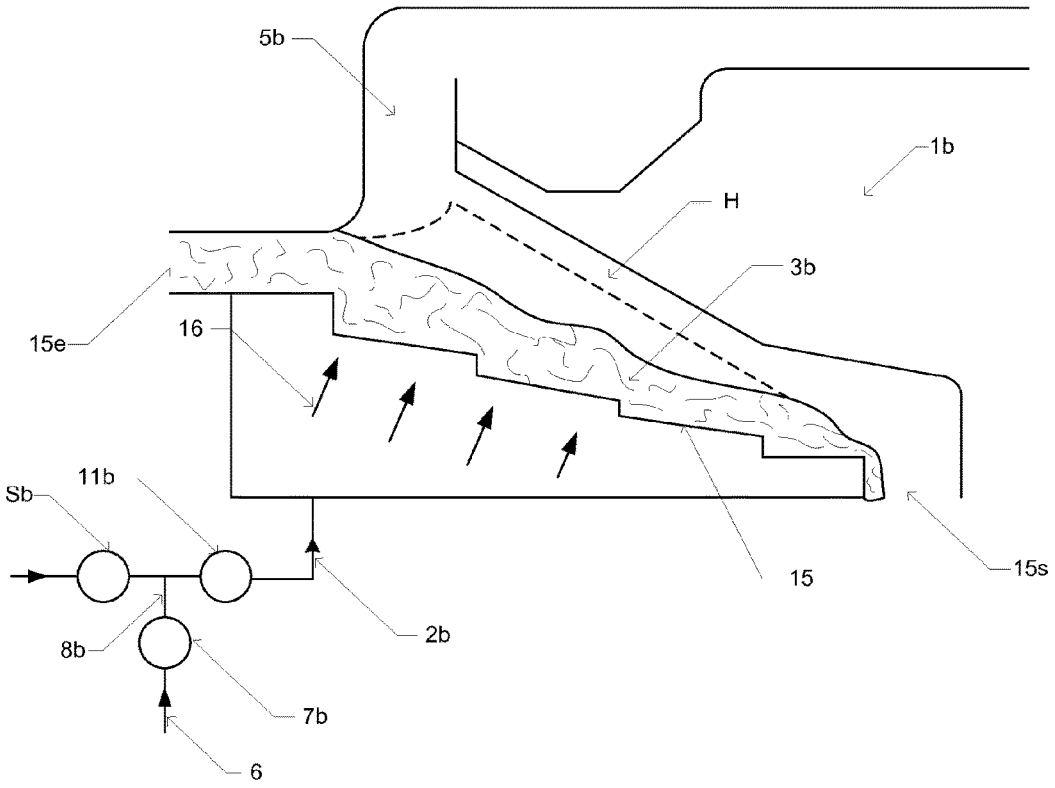
FIG. 2 schematically shows, similarly to FIG. 1, a waste incineration furnace containing a grate.

According to the embodiment from FIG. 2, the reducing agent could also be introduced into the materials to be burned or into the fuel injected at the inlet 15*e*.

When the denitrifying reducing agent 6 is injected directly into the fuel before the introduction thereof into the furnace, the reducing agent is vaporized at the same time as the water and the volatile component contained in the fuel. The distribution of the reducing agent is ensured, in the same way as the fuel feed, by the fluidization of the bed B or, in the case of a grate furnace (as shown in FIG. 2), by the mixing of the ash and of the combustion material of the bed 3*b*.

The intense mixing, in addition to ensuring that the homogeneity and the catalytic action of the bed B or of the ash bed 3*b* are obtained, makes it possible to carry out denitrification reactions that are catalyzed at relatively low temperature, of the order of 800° C., which would only be possible in the homogeneous gas/gas phase at higher temperatures.

The catalytic heterogeneous reactions are of the type:

$4NH_3+4NO+O_2+C \rightarrow N_2+H_2O$ (catalysis of the waste by carbon), $4NH_3+4NO+O_2+CaO \rightarrow N_2+H_2O$ (catalysis of the waste by ash).

If the reactions are not complete, the higher temperature and the residence time of greater than 2 s (2 seconds) in the post-combustion zone 5, 5*b*, enable denitrification reactions at 850° C.-870° C. in the homogeneous phase, without having the drawbacks of a conventional SNCR process.

In the case where the denitrifying reducing agent is injected into the combustion/fluidization air, the mixture passes through the waste to be burned.

The wind box A located under the combustion chamber is the place that enables the homogeneous and controlled distribution of the combustion air in the chamber. It is an empty zone, for which the connection with the combustion chamber consists of an arch a1 with orifices, or of a grate 15 which can be formed by a simple pierced orifice, or by distribution nozzles, or of a mobile grate or any other means enabling the homogeneous distribution of the air in the combustion chamber.

The combustion air arrives in the wind box after having been preheated, or not, in a preheater E1 that may be an air-flue gases, air-vapor, air-oil or water exchanger or any other system that makes it possible to raise the temperature of the combustion air.

The reducing agent 6 is mixed by means of a distribution rod (not represented) implanted in the re-heated combustion air line or duct 2*a*,2*b* between the preheater and the wind box. If the reducing agent is in aqueous form, it is first vaporized by injection of vapor, compressed air or any other means enabling a good distribution in the duct between the preheater and the wind box.

The metering of the amount of reducing agent is ensured by a control valve 7*a*,7*b* placed on the pipework of the reducing agent before, or preferably after, the vaporization. This valve may be controlled as a function of the content of NOx and/or of $NH_3$ measured downstream.

The reducing agent is then conveyed to the furnace via the wind box and the grate.

In particular, in a fluidized bed, such as the bed B from FIG. 1, the pressure loss of the nozzles a2 enables a homogeneous distribution of the stream of combustion air loaded with reducing agent. A similar phenomenon occurs in the case of a grate furnace such as that from FIG. 2. Next, the passage of the combustion air loaded with the reducing agent into the bed B or into the bed 3*b* ensures an intense mixing between the nitrogen oxides NOx and the reducing agent in order to promote the reduction reaction. In addition to obtaining the homogeneity, the coexistence of the nitrogen oxides NOx/reducing agent/ catalytic bed (sand+ash) enables denitrification reactions to take place that are catalyzed at relatively low temperature (800° C.).

Figure 3:
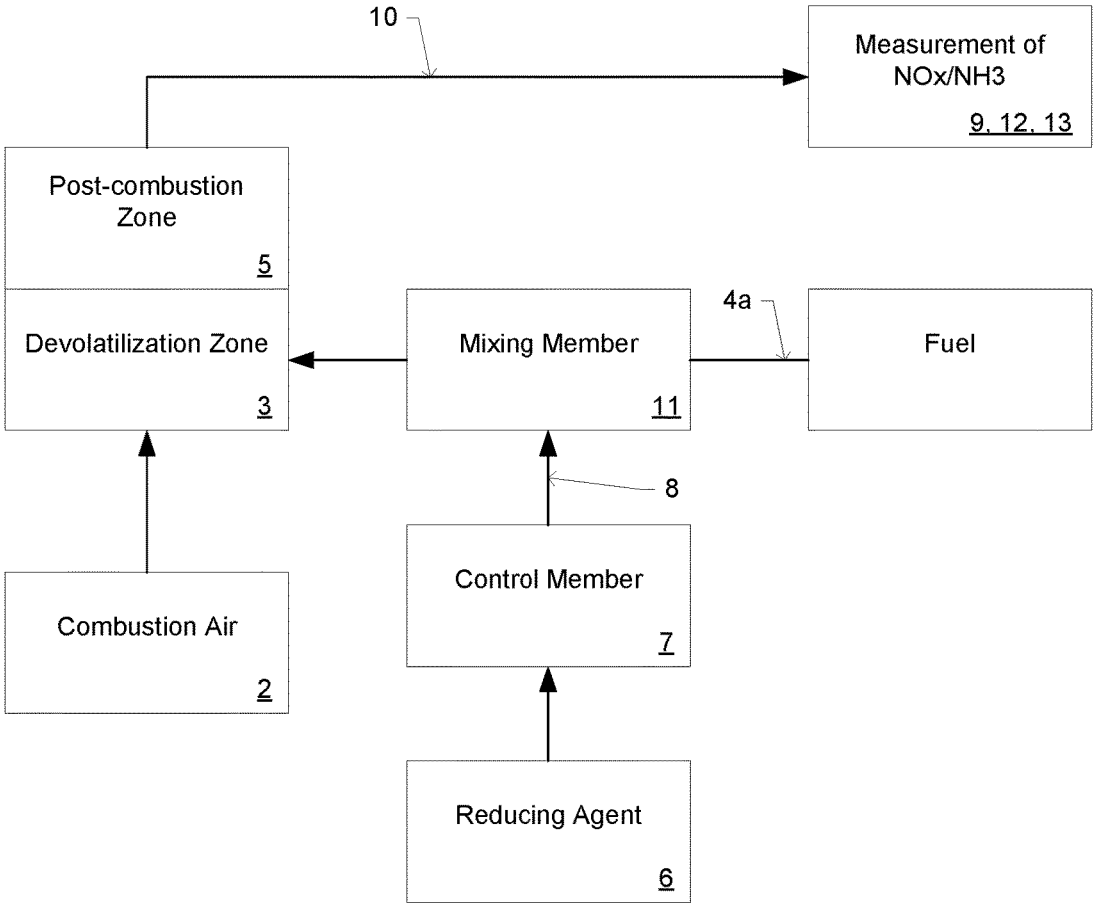
FIG. 3 is a block diagram of the process with injection of the reducing agent into the fuel.

FIG. 3 is a block diagram summarizing the operation of the invention in the case where the reducing agent is injected into the fuel.

The fuel arrives via the line 4*a* into the mixing member 11, which receives, by means of the control member 7, the reducing agent 6.

The mixture obtained at the outlet of the member 11 is homogeneous and a good contact is ensured between the fuel and the reducing agent. This mixture is introduced into the devolatilization zone 3 of the furnace 1. The combustion air and fluidization air is injected into this zone 3. The combustion is continued in the post-combustion zone 5. The sensors 9, 12 and 13 ensure the measurement of the concentrations of nitrogen oxides NOx and $NH_3$ in the flue gases which leave via the line 10.

Figure 4:
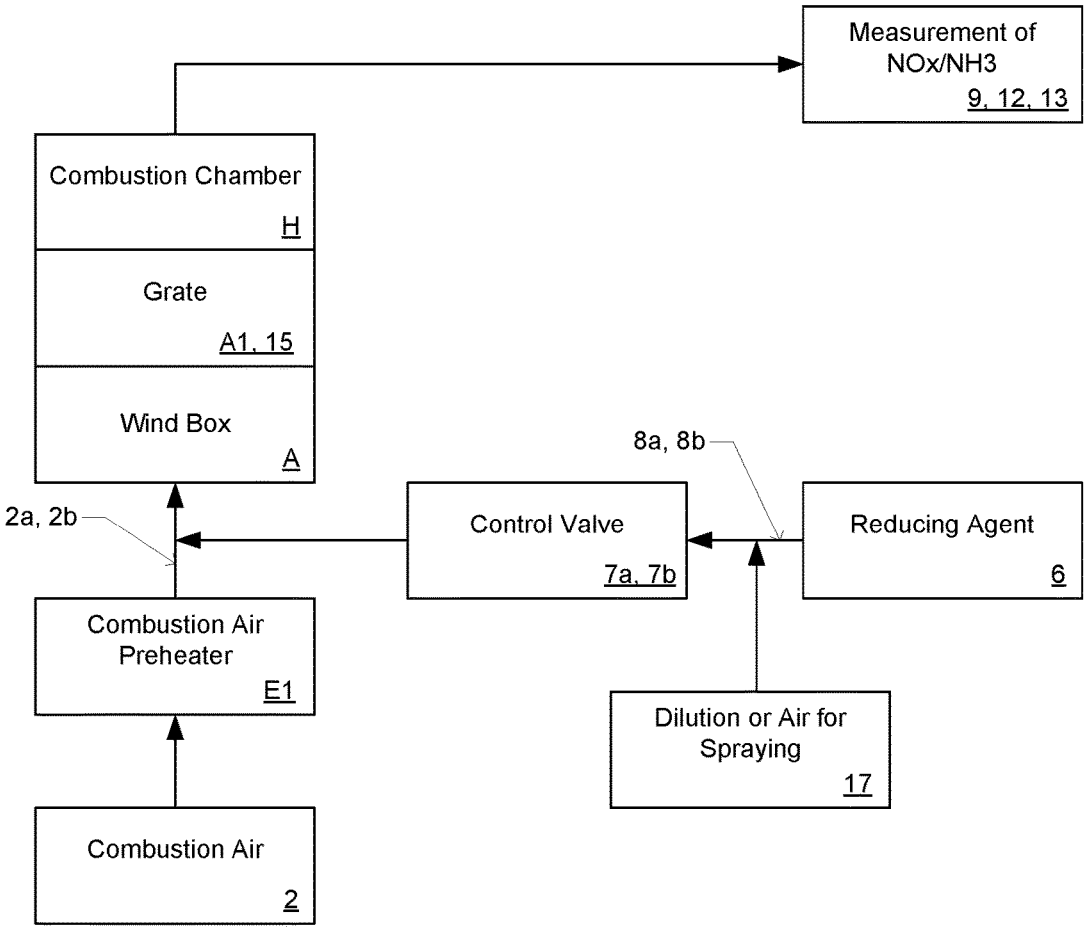
FIG. 4 is a block diagram of the steps of the process when the reducing agent is introduced into the combustion air.

FIG. 4 is a block diagram illustrating the operation of the invention when the reducing agent is injected into the combustion air.

The reducing agent 6 is conducted via the line 8*a*,8*b* to the control valve 7*a*,7*b* before being injected into the combustion air line 2*a*,2*b*, which, generally, has been preheated by a preheater E1 with the aid of the flue gases. It is possible to provide, upstream of the control valve 7*a*, 7*b*, a dilution or an injection of air for spraying 17 into the reducing agent 6.

The mixture of combustion air and of reducing agent is introduced into the wind box A or under the grate 15, in the case of a grate furnace, then into the combustion chamber from which the flue gases leave via the line 10.

According to the invention, the nitrogen oxides NOx are destroyed in the sand bed B or in the ash bed 3*b*, the mineral portion of which acts as a catalyst.

At the start of combustion, the speed of introduction of the sludge or material to be burned is increased in order to form a layer, in particular the bed 3*b* in the case of a grate furnace. This start-up phase may last around 10 to 15 minutes.

The invention makes it possible to ensure an effective denitrification of the flue gases produced by a combustion furnace, in particular a furnace for incinerating waste or sludge from municipal water or industrial water purification plants.

What is claimed is:

1. A method of removing NOx from flue gases in a furnace for incinerating waste or sludge from a municipal water or industrial water purification plant, the furnace comprising a combustion chamber with a bed of sand or ash, the method comprising the following steps:

introducing the waste or sludge as a fuel into a devolatilization zone of the furnace in which the sand or ash is located and in which the fuel loses volatile components during combustion such that the devolatilization zone is constituted by the bed comprising sand or ash along with the fuel;

introducing a reducing agent in a vaporized form into at least one of the combustion air upstream of a wind box of the furnace and the fuel;

introducing the combustion air into the wind box of the furnace positioned below the devolatilization zone, the wind box providing distribution of the combustion air into the bed and mixing of the bed with the combustion air, wherein the combustion air is introduced solely through the wind box;

wherein the reducing agent is introduced solely upstream of said devolatilization zone;

measuring nitrogen oxide and/or ammonia levels of treated flue gases downstream of a post-combustion zone of the furnace located downstream of the devolatilization zone; and regulating the introduction of the reducing agent in order to maintain pre-established nitrogen oxide content and/or ammonia levels;

wherein the reducing agent is an ammonia ($NH_3$) compound causing a reduction of nitrogen oxides to nitrogen, wherein the reduction of nitrogen oxides to nitrogen is carried out in the bed, according to reactions of the following type:

$4NH_3+4NO+O_2+C \rightarrow N_2+H_2O$(catalysis of the waste or sludge by carbon), $4NH_3+4NO+O_2+CaO \rightarrow N_2+H_2O$(catalysis of the waste or sludge by ash).

2. The method of claim 1, wherein the reducing agent is diluted with water.

3. The method of claim 1, wherein said introducing of the reducing agent comprises injecting the reducing agent into the fuel prior to the step of introducing the fuel into the devolatilization zone of the furnace.

4. The method of claim 1, wherein the introduction of the reducing agent and the fuel comprises mixing the reducing agent and the fuel in a separate vessel before introduction to the furnace.

5. The method of claim 1, wherein the furnace comprises a fluidized bed furnace in which the bed comprises sand and wherein the distribution of the combustion air provides fluidization of the bed.

6. The method of claim 1, wherein the furnace comprises a fluidized bed furnace in which the bed comprises sand and the distribution of the combustion air provides fluidization of the bed, and wherein temperature of the sand bed is maintained by controlling one or more of:

temperature of the fluidizing combustion air;

stoichiometry of the combustion air;

depth of the sand bed; and/or use of auxiliary fuel.

7. A method of removing NOx from flue gases in a furnace for incinerating solid waste from a municipal water or industrial water purification plant, the furnace comprising a combustion chamber with a bed of sand or ash, the method comprising the following steps:

introducing solid waste and sand or ash into a devolatilization zone of the furnace to form the bed, the bed of sand or ash with solid waste constituting the devolatilization zone;

introducing combustion air via a wind box into the devolatilization zone of the furnace such that the solid waste and sand or ash are mixed within the devolatilization zone of the furnace by the combustion air, the wind box being the sole entry of the combustion air;

vaporizing a reducing agent and adding the reducing agent to at least one of the combustion air in the wind box before the combustion air is introduced into the furnace and the solid waste upstream of the devolatilization zone, such that the reducing agent is combined with the solid waste and sand or ash while being mixed;

wherein the reducing agent is introduced solely upstream of said devolatilization zone;

measuring nitrogen oxide and/or ammonia levels of treated flue gases downstream of a post-combustion zone of the furnace located downstream of the devolatilization zone; and regulating the introduction of the reducing agent in order to maintain pre-established nitrogen oxide content and/or ammonia levels;

wherein the reducing agent is an ammonia ($NH_3$) compound causing a reduction of nitrogen oxides to nitrogen present in the furnace, wherein the reduction of nitrogen oxides to nitrogen is carried out into the bed, according to reactions of the following type:

$4NH_3+4NO+O_2+C \rightarrow N_2+H_2O$(catalysis of the waste by carbon), $4NH_3+4NO+O_2+CaO \rightarrow N_2+H_2O$(catalysis of the waste by ash), wherein the temperature of the combustion chamber lies between 850° C. and 870° C.

* * * * *